US005683123A

United States Patent [19]

Ruoss

[11] Patent Number: 5,683,123

[45] Date of Patent: Nov. 4, 1997

[54] SECURITY GRILL SYSTEM

[76] Inventor: Peter A. Ruoss, P.O. Box 1234, Princeton, British Columbia, Canada, V0X 1W0

[21] Appl. No.: 634,264

[22] Filed: Apr. 18, 1996

[30] Foreign Application Priority Data

Apr. 19, 1995 [CA] Canada ..... 2147306

[51] Int. Cl.[6] ..... F05C 5/02

[52] U.S. Cl. ..... 292/57; 292/202; 49/57; 49/141

[58] Field of Search ..... 292/57, 202, 204; 49/141, 56, 57

[56] References Cited

U.S. PATENT DOCUMENTS

| | | | |
|---|---|---|---|
| 344,473 | 6/1886 | Bond | 292/202 |
| 875,087 | 12/1907 | Mackintosh | 292/57 |
| 1,040,963 | 10/1912 | Strong et al. | 292/57 |
| 2,542,130 | 2/1951 | Friend | 292/337 |
| 2,595,436 | 5/1952 | Abdallah et al. | 292/204 |
| 2,801,868 | 8/1957 | Carson | 292/202 |
| 2,891,615 | 6/1959 | Farrell | 160/369 |
| 3,794,365 | 2/1974 | Richberg | 292/62 |
| 4,055,360 | 10/1977 | Russi | 292/228 |
| 4,057,935 | 11/1977 | Rohrberg et al. | 49/56 |
| 4,070,048 | 1/1978 | Young | 292/179 |
| 4,127,293 | 11/1978 | Moreno | 292/251 |
| 4,208,837 | 6/1980 | Black, Sr. et al. | 49/56 |
| 4,274,228 | 6/1981 | Kondracki | 49/56 |
| 4,634,157 | 1/1987 | Fernandez | 292/218 |
| 4,671,012 | 6/1987 | Merklinger et al. | 49/57 |
| 4,856,229 | 8/1989 | Tseng | 49/141 |
| 4,897,961 | 2/1990 | Shine | 49/141 |
| 5,174,063 | 12/1992 | Lewis et al. | 49/141 |
| 5,404,674 | 4/1995 | Gethers, Jr. | 49/141 |

*Primary Examiner*—Rodney M. Lindsey
*Attorney, Agent, or Firm*—George A. Seaby

[57] ABSTRACT

Locks for security grills used on doors or windows tend to be structurally complicated, and consequently expensive to produce and/or install. A relatively simple lock assembly for use with a security grill includes a box for mounting on one edge of a grill, a slot in one side of the box for opposing the frame of the door or window when the grill is closed, a plate for mounting on the outside of the frame in opposition to the box, whereby the plate completely covers the slot when the grill is closed, a bolt extending through the plate for rotatable mounting in the frame in alignment with the slot, an ear on the outer end of the bolt for insertion through the slot into the box when the grill is moved to the closed position, and a handle on the inner end of the bolt for rotating the latter between a release position in which the ear can be inserted into or removed from the box via the slot and a locked position in which the ear is retained by a projection in the box. By providing a helical spring in a sleeve extending into the frame from the sleeve and outwardly against the slot containing side of the box, the box is biased outwardly to increase the locking effect of the projection on the ear.

8 Claims, 5 Drawing Sheets

SECURITY GRILL SYSTEM

BACKGROUND OF THE INVENTION

1. Field of the Invention

This invention relates to a lock, and in particular to a lock assembly for use with a security grill of the type used on a door or window.

2. Description of the Prior Art

The patent literature describes a large variety of locks for use on doors, windows and safety or security grills used on such doors or windows. Examples from the literature include U.S. Pat. Nos. 3,331,161, which issued to R. O. Ruff on Jul. 18, 1967; 3,843,176, which issued to A. Gonzalez-Cuzan on Oct. 22, 1974; 3,921,334, which issued to W. R. Black, Sr. on Nov. 25, 1975; 4,055,360, which issued to B. C. Russi on Oct. 25, 1977; 4,057,935, which issued to R. G. Rohrberg et al on Nov. 15, 1977; 4,070,048, which issued to P. Young on Jan. 24, 1978; 4,208,837, which issued to W. R. Black, Sr. et al on Jun. 24, 1980; 4,263,747, which issued to G. E. Coltrin et al on April 28, 1981; 4,566,222, which issued to C. C. Hatvany on January 28, 1986; 4,634,157, which issued to J. S. Fernandez on Jan. 6, 1987; 4,653,226, which issued to E. L. Woodrow on Mar. 31, 1987 and 4,796,384, which issued to D. R. Warwick on Jan. 10, 1989.

The devices disclosed by the above listed patents vary in terms of complexity and efficacy. It will be appreciated that the more complicated the device, the greater the initial expense, and the more difficult it is to install and maintain the lock. It is the opinion of the present inventor that, for the most part, the patented devices are unnecessarily complicated.

GENERAL DESCRIPTION OF THE INVENTION

The object of the present invention is to avoid the above mentioned drawbacks of existing locks by providing a relatively simple, easily installed and virtually indestructible lock assembly for use with a security grill of the type pivotally mounted in a door or window frame. Because the lock assembly has few moving parts, there is very little that can go wrong with the assembly, and the simple structure translates into easy production and operation.

According, the present invention relates to a lock assembly for use with a security grill which is intended for pivotal mounting in a door or window frame for rotation between open and closed positions, said lock assembly comprising box means for attachment to one edge of the grill; slot means in one side of said box means opposing the frame when the grill is in the closed position; first plate means for mounting on one side of the frame in opposition to the box means, whereby the first plate means covers said slot means in the closed position of the grill; bolt means extending through said first plate means for rotatable mounting in the frame in alignment with said slot means when the grill is in the closed position; ear means on one end of said bolt means for insertion through said slot means when the grill is moved to the closed position; and handle means on the other end of said bolt means for rotating the bolt means between a release position in which the ear means can be inserted into or removed from said box means via said slot means and a locked position in which said ear means is retained by said one side of said box means.

BRIEF DESCRIPTION OF THE DRAWINGS

The invention is described hereinafter in greater detail with reference to the accompanying drawings, which illustrate a preferred embodiment of the invention, and wherein.

DESCRIPTION OF THE PREFERRED EMBODIMENT

While, as mentioned above, the lock assembly of the present invention can be used with a door or window, for the sake of simplicity, the following description relates only to a grill on a window.

Figure 1:
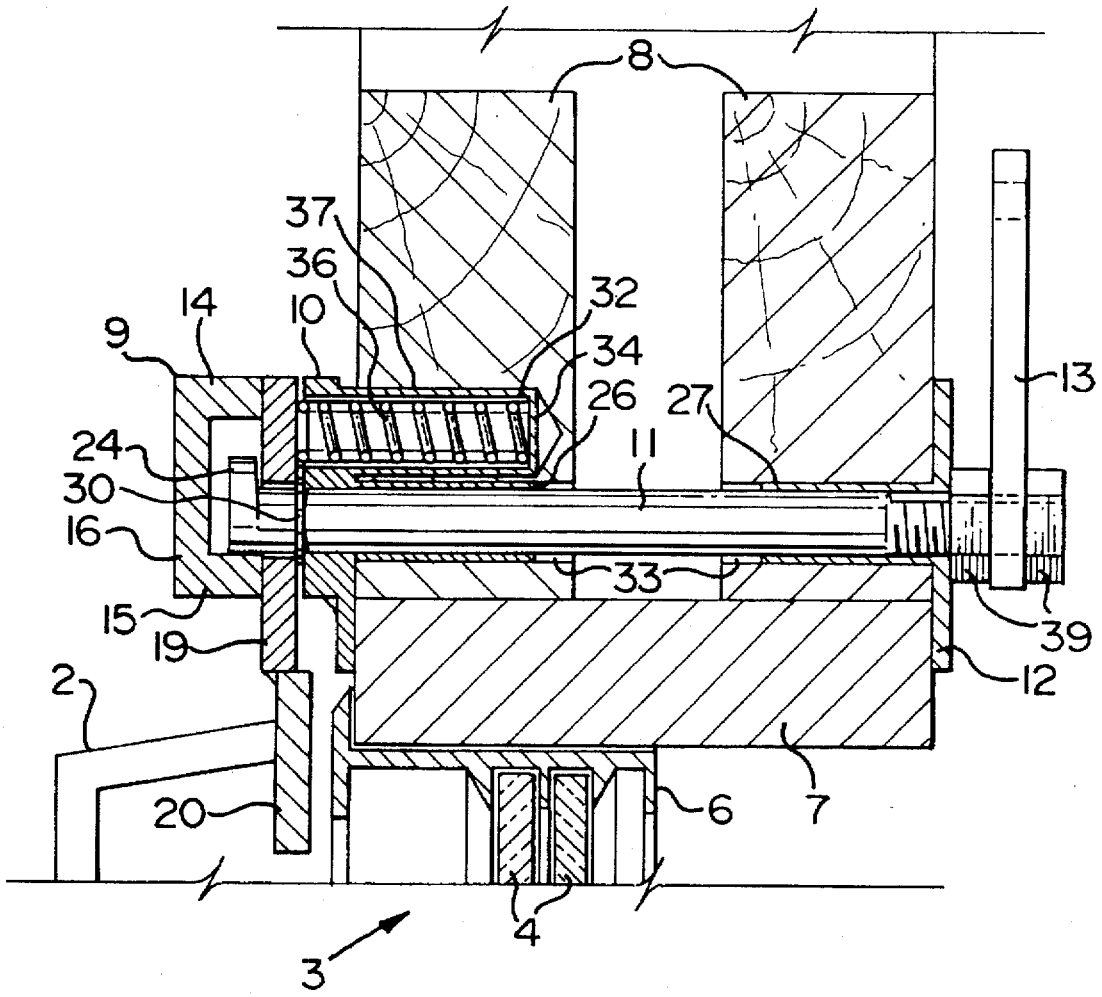
FIG. 1 is a schematic, cross-sectional view of the top of a window frame incorporating a grill and a lock assembly in accordance with the present invention.

Referring to FIG. 1, the lock assembly of the present invention is intended to lock a security grill 2 in the closed position over a window generally indicated at 3. The window in this case is a conventional sliding window of the type including a plurality of glass panes 4 slidably mounted in a sash 6. The sash 6 is mounted in a wooden frame including a lintel formed by wooden 2"×6" boards 7 and 8. The principal elements of the assembly 1 include a box 9, a plate 10, a bolt 11, a plate 12 and a handle 13 mounted on the bolt 12. All of the elements of the assembly are formed of metal. However, some of the elements could be formed of hard plastic.

Figure 2:
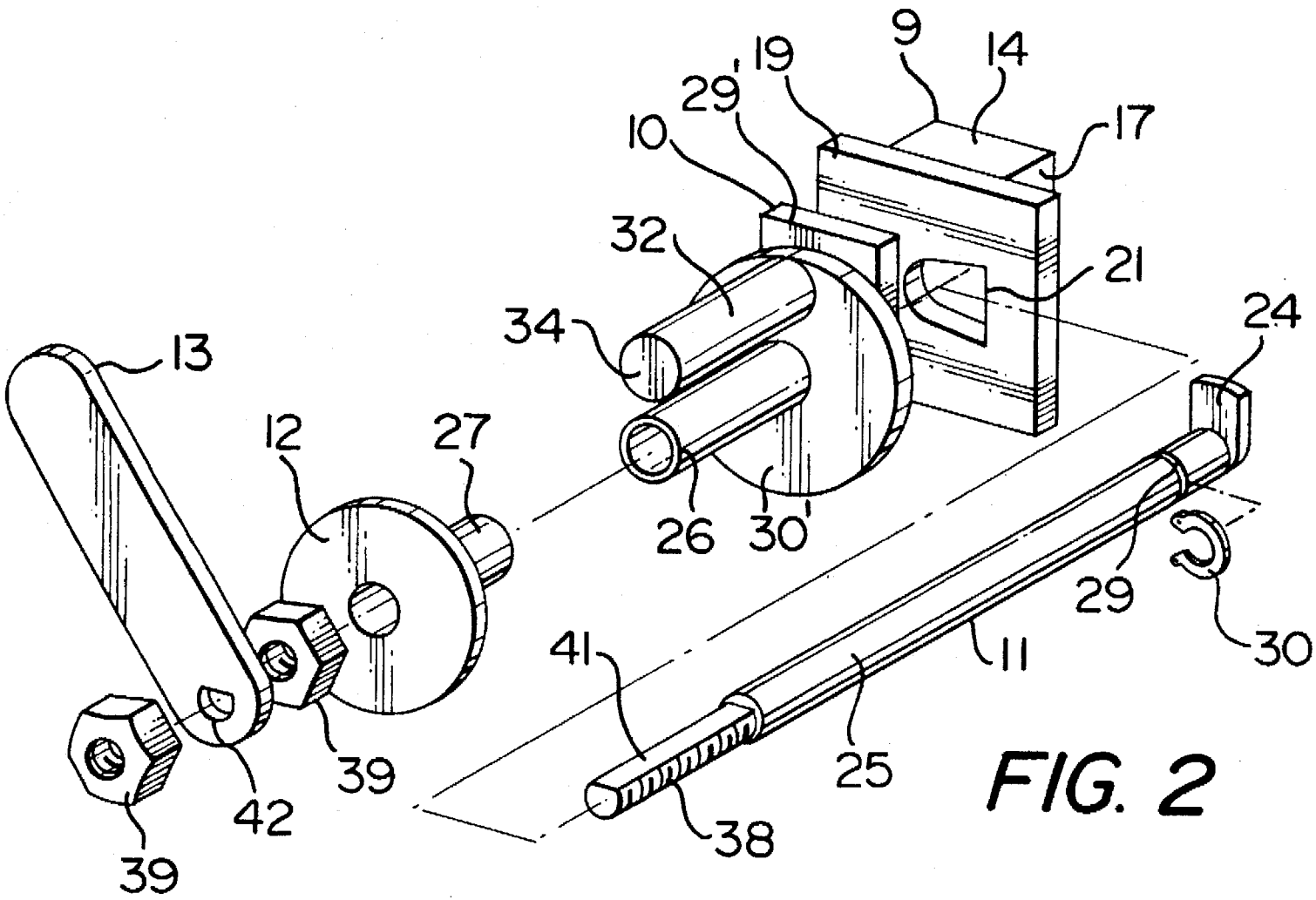
FIG. 2 is an exploded, isometric view of the lock assembly of FIG. 1.

The box 9 includes a top wall 14, a bottom wall 15, one side wall 16 and end walls 17 (one shown in FIG. 2). The open side of the box 9 is closed by a plate 19, which extends from the top wall 14 to a point beyond the bottom wall 15 and beyond each of the end walls 17. The plate 19 is welded to the top end 20 of the frame of the grill 2, so that the box 9 is located above the grill 2. A slot 21 resembling a generally round arch on its side is provided in the plate 19 for receiving one end of the bolt 11. A projection 23 is provided on the plate 19 at the inner top edge of the slot 21. The projection 23 acts as a stop for an ear 24 extending outwardly from one side of the bolt 11 perpendicular to the longitudinal axis thereof. The ear 24 is slightly smaller than, but roughly the same shape as the slot 21. Thus, the bolt 12 can be inserted through the slot 21 into the box 9 and rotated to a locked position (FIG. 3) in which the ear 24 engages the projection 23. The projection 23 can be formed by deforming the top edge of the slot 21 prior to assembly of the box 9.

The shank 25 of the bolt 11 is rotatably mounted in the frame of the window 3. At the outer end, the bolt 11 extends through the plate 10, a sleeve 26 on the inside of the plate 10, a second sleeve 27 on the inside of the window frame and a plate 28 carrying the sleeve 27. An annular groove 29 is provided in the shank 25 of the bolt 11 near the ear 24. The groove 29 carries C-clip 30, which bears against the plate 10 to prevent sliding of the bolt 11 in the window frame. The clip 30 also bears against the plate 19 when the grill 2 is closed to ensure proper spacing between the plate 10 and the ear 24, so that the ear engages the plate 19 in the box 9. As best shown in FIG. 2, the plate 10 is formed of two pieces 29' and 30' of metal which are welded together. The outer rectangular piece 29 defines a flat bearing surface for the plate 19 on the box 9. The circular inner piece 30' carries the sleeve 26 and a socket 32. The sleeves 26 and 27 are mounted in holes 33 drilled through the boards 8, and act as bushings for rotatably supporting the bolt 11. The socket 32 has a closed inner end 34, and carries a helical spring 36. The socket 32 is mounted in a blind hole 37 (FIG. 1) drilled into the outermost board 8 above the outer hole 33. The spring 36 extends a short distance out of the socket 32 for biasing the box 10 outwardly when the grill 2 is in the fully closed position (FIG. 1).

As best shown in FIG. 2, the inner end 38 of the shank 25 is threaded for receiving nuts 39, which hold the handle 13 on the bolt, and retain the bolt in the proper position in the sleeves 26 and 27. One side 41 of the inner end 38 of the shank 25 of the bolt 11 is flattened for insertion through a hole 42 in one end of the handle 13. The hole 42 has the same shape as a cross section of the end 38 of the bolt 11 to prevent rotation of the handle 13 relative to the bolt 11, i.e. the bolt 11 rotates with the handle 13.

In operation, with the lock assembly in the closed position shown in FIG. 1, rotation of the ear 24 by moving the handle 13 in a counterclockwise direction (FIG. 3) overcomes the locking action of the projection 23. The ear 24 is rotated until it hits the bottom wall 15 of the box 9. In this position, the ear 24 is in perfect alignment with the slot 21, and consequently the grill 2 is released and can be opened. Since the ear 24 is positively stopped in the correct position, there is no need (in an emergency or otherwise) to search for the correct release position. In order to close the grill 2, the handle 13 is used to rotate the bolt 11 to a position in which the ear 24 is properly aligned with the slot 21, i.e. to a position in which the ear 24 can enter the box 9. With the ear 24 in the box 9, the grill 2 is pulled inwardly so that the plate 19 compresses the spring 36. It will be appreciated that the grill 2 can be pulled inwardly (from inside a building) to apply pressure to the spring 36. The handle 13 is rotated to orient the ear 24 properly. When the ear 24 stops in a vertical position against an end wall 17 (FIG. 3), the ear is in the proper position. When the grill 2 is released, the projection 23 prevents free rotation of the bolt 11 to securely lock the grill in the closed position. Because the ear 24 is housed in the box 9, it is impossible to gain access to the bolt 11 without breaking the assembly.

Figure 6:
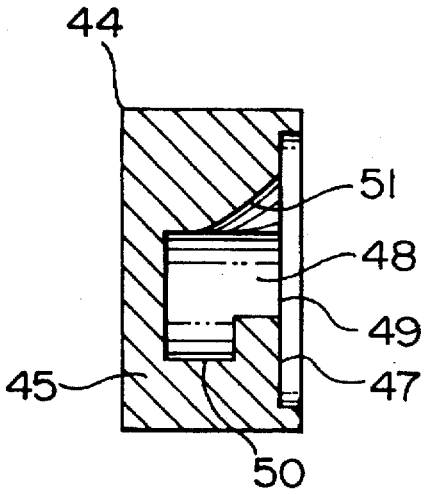
FIG. 6 is a cross section taken generally along line VI—VI of FIG. 5.
Figure 5:
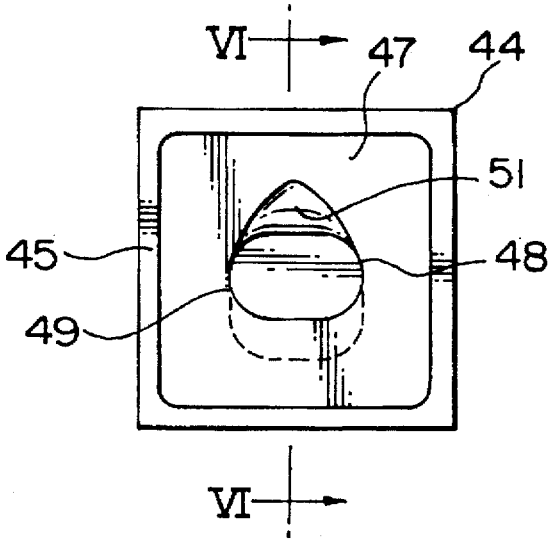
FIG. 5 is a front view of a second embodiment of a box used in a lock assembly similar to the assembly of FIGS. 1 and 2.
Figure 7:
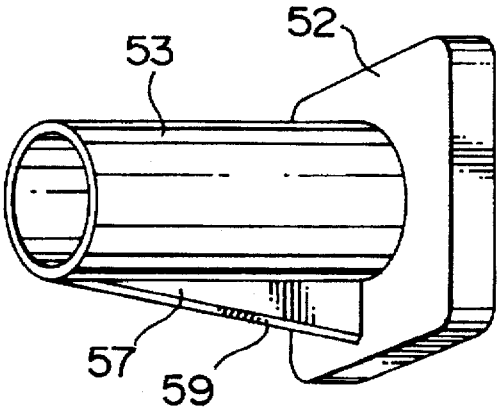
FIG. 7 is an isometric view of a second embodiment of a plate and sleeve assembly used in an assembly similar to that of FIGS. 1 and 2.

With reference to FIGS. 5 and 6, in a second embodiment of the invention, the box 9 is replaced by a box 44, which includes a solid, rectangular body 45 welded to the top end 20 (FIG. 1) of the grill 2 so that the box 44 is located above the grill 2. A generally rectangular recess 47 is provided in the inner side of the body 45. A bolt-receiving slot 48 extends into the body 45 from the center of the recess 47. The outer end 49 of the slot 48 is generally drop-shaped, and the inner end 50 (FIG. 6) thereof is L-shaped. The top of the slot 48 is inclined defining a ramp 51.

Figure 8:
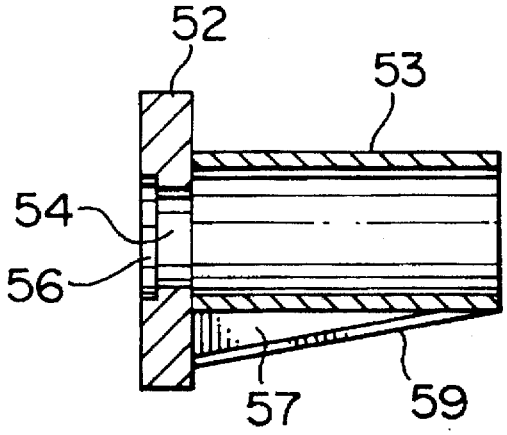
FIG. 8 is a longitudinal sectional view of the plate and sleeve assembly of FIG. 7.

In the second embodiment of the invention, the plate 10 is replaced by a plate 52 with a sleeve 53 extending outwardly from the inner surface thereof. A hole 54 (FIG. 8) in the plate 52 receives the bolt 11 which is retained in position by a C-clip 30 and nuts 39 (FIG. 1). The C-clip 30 seats in the countersunk outer end 56 of the hole 54 so that the plate 10 fully enters or seats in the recess 47 in the box 44 when the grill 2 is closed. A triangular blade 57 extends downwardly from the sleeve 53, facilitating insertion of the sleeve into a board 8 (FIG. 1) defining the outside of the lintel. A sharp bottom edge 59 on the blade cuts into the bottom of a hole (not shown) drilled into the outer board 8. Thus, the plate 52 and the sleeve 53 can be hammered into position, facilitating installation of the lock.

Figure 3:
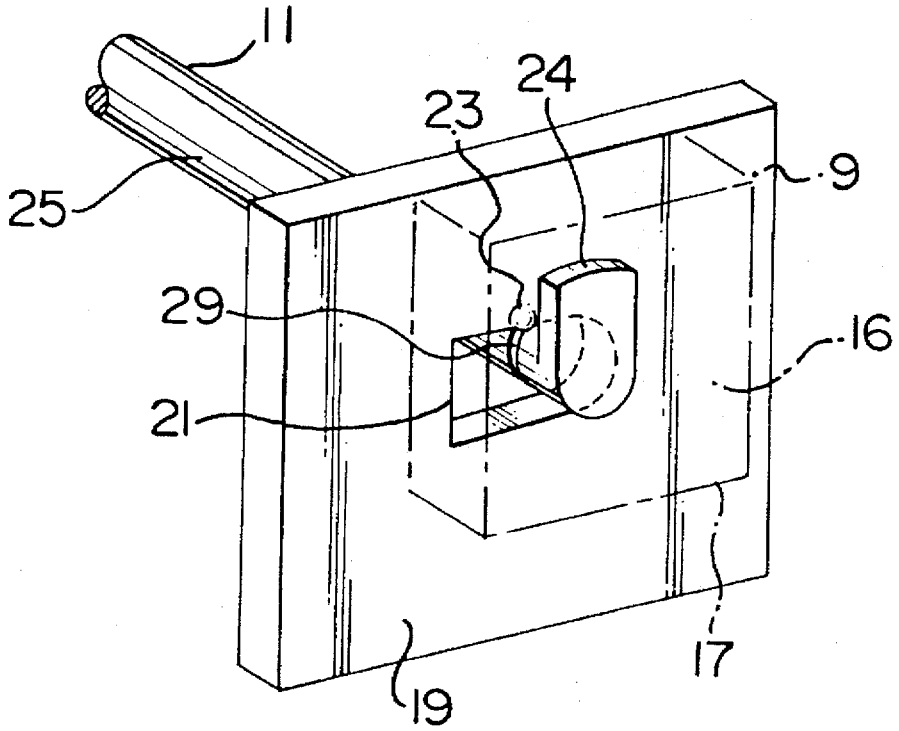
FIG. 3 is an isometric view of a box and one end of a bolt used in the assembly of FIGS. 1 and 2.
Figure 4:
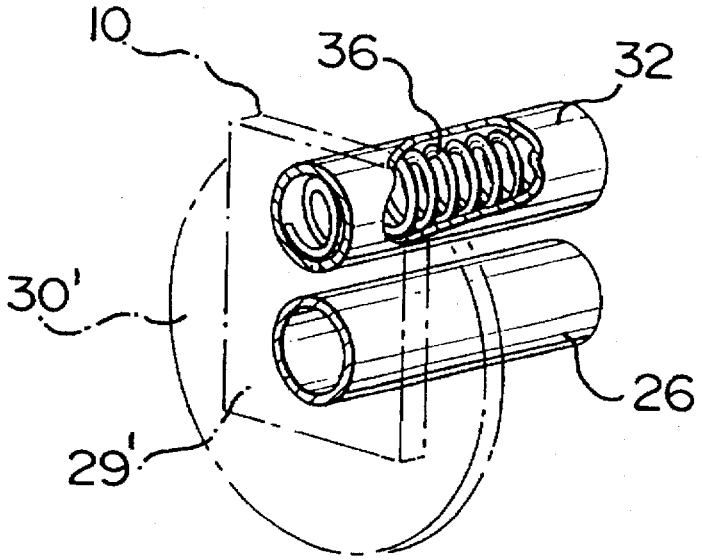
FIG. 4 is a partly sectioned, isometric view of a plate, sleeve and socket combination used in the assembly of FIGS. 1 and 2.
Figure 9:
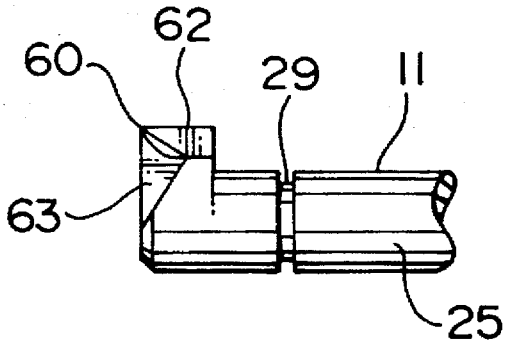
FIG. 9 is a side view of one end of a bolt used with the box of FIGS. 5 and 6.
Figure 10:
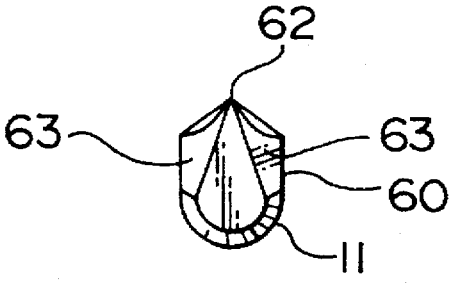
FIG. 10 is an end view of the bolt of FIG. 9, as viewed from the left.

Referring to FIGS. 9 and 10, the bolt 11 is similar to the bolt of FIGS. 2 and 3, including a shank 25 and an ear 60 similar to the ear 24 (FIGS. 2 and 3). An annular groove 29 in the shank 25 of the bolt 11 receives a C-clip 30 (not shown in FIGS. 9 and 10) for anchoring the outer end of the bolt 11 in the plate 52. The ear 60 includes a triangular top end 62 and tapered sides 63. Thus, when the ear 60 enters the slot 48, i.e. when the grill is closed, bevelled edges, i.e. the top end 62 and the tapered sides 63 engage and slide on the ramp 51. By rotating the bolt 11, the ear 60 slides into the slot ultimately coming to rest in the L-shaped inner end 50 thereof. For such purpose, the bottom of the slot 48 (as illustrated in FIG. 5) is wider than the ear 60.

It will be noted that the second embodiment of the invention is simpler than the first embodiment, omitting the second sleeve 27 for properly locating the plate 10 in the window frame, and the spring 36. Not only is the second embodiment of the invention simpler than the first, but the second plate 52 of the second embodiment is easier to install than the first embodiment. It's necessary to drill one hole only in the window frame, the blade 57 making the plate 52 self-locating, provided the blade is positioned vertically beneath the sleeve 53 during installation. Because the plate 52 is completely surrounded by the sides of the recess 47 when the lock is closed, a pry bar or other lever cannot be inserted between the box 44 and the plate 52 in an attempt to break the lock.

Thus, there has been described a relatively simple lock assembly for a door or window security grill which has few moving parts, and which is easy to install and to operate.

I claim:

1. A lock assembly for use with a security grill which is intended for pivotal mounting in a door or window frame for rotation between open and closed positions, said lock assembly comprising a discrete, hollow box for attachment to one edge of the grill, said box being closed an all sides; a slot in one side of said box for opposing the frame when the grill is in the closed position; a first plate for mounting on one side of the frame in opposition to the box, whereby the first plate covers said slot and a substantial portion of said one side of said box around said slot in the closed position of the grill; a bolt extending through said first plate for rotatable mounting in the frame in alignment with said slot when the grill is in the closed position; an ear on one end of said bolt for insertion through said slot when the grill is moved to the closed position; and a handle on the other end of said bolt for rotating the bolt between a release position in which the ear can be inserted into or removed from said box via said slot and a locked position in which said ear is retained by said one side of said box.

2. The lock assembly of claim 1, including a projection on an interior surface of said one side in said box for releasably retaining said ear in the locked position.

3. The lock assembly of claim 2, including a first sleeve on said first plate for mounting in the frame, said first sleeve rotatably supporting said one end of said bolt in the frame and retaining said first plate on the frame.

4. The lock assembly of claim 3, including a socket extending through said first plate for mounting in the frame; and a spring for mounting in said socket for biasing said box outwardly when the grill is in the closed position to enhance retention of said ear by said projection.

5. The lock assembly of claim 4, including a second plate for mounting on a second side of the frame opposite said one side; and a second sleeve on said second plate for mounting in said second side of the frame to rotatably support the other end of said bolt in the frame.

6. The lock assembly of claim 1, wherein said box includes a recess around an outer end of said slot for receiving said first plate when the grill is in the closed position.

7. The lock assembly of claim 6, including a ramp in said slot for slidably receiving said ear when the grill is moved to the closed position; and a bevelled edge on said ear for sliding on said ramp when said ear enters said slot, whereby the ear is guided into said slot.

8. The lock assembly of claim 6, including a first sleeve on said first plate for mounting in the frame, said first sleeve rotatably supporting said one end of said bolt in the frame and retaining said first plate on the frame; and a blade on said first sleeve for penetrating the frame to facilitate mounting of said first sleeve on said one side of the frame.

* * * * *